US006481432B2

(12) United States Patent
Rushton et al.

(10) Patent No.: US 6,481,432 B2
(45) Date of Patent: Nov. 19, 2002

(54) PAINTBALL HOPPER

(75) Inventors: Ennis Rushton, Litchfield Park, AZ (US); Douglas M. Odom, Midvale, UT (US); Mark Wenzel, Salt Lake City, UT (US); Joseph Harris, West Jordan, UT (US); Gregory Misbach, Orem, UT (US); Gordon B. Langford, Heber City, UT (US)

(73) Assignee: American International Marketing, Inc., Litchfield Park, AZ (US)

( * ) Notice: Subject to any disclaimer, the term of this patent is extended or adjusted under 35 U.S.C. 154(b) by 0 days.

(21) Appl. No.: 09/838,693

(22) Filed: Apr. 19, 2001

(65) Prior Publication Data

US 2001/0039945 A1 Nov. 15, 2001

Related U.S. Application Data

(60) Provisional application No. 60/202,488, filed on May 5, 2000.

(51) Int. Cl.[7] ..... F41B 11/02
(52) U.S. Cl. ..... 124/49
(58) Field of Search ..... 124/49, 50, 51.1, 124/73

(56) References Cited

U.S. PATENT DOCUMENTS

| | | | |
|---|---|---|---|
| 5,282,454 | A | 2/1994 | Bell et al. |
| 5,505,188 | A | 4/1996 | Williams |
| 5,722,383 | A | 3/1998 | Tippmann, Sr. et al. |
| 5,791,325 | A | 8/1998 | Anderson |
| 5,794,606 | A | 8/1998 | Deak |
| 5,816,232 | A | 10/1998 | Bell |
| 5,839,422 | A | 11/1998 | Ferris et al. |
| 5,947,100 | A | 9/1999 | Anderson |

*Primary Examiner*—John A. Ricci
(74) *Attorney, Agent, or Firm*—Holme Roberts & Owen

(57) ABSTRACT

A paintball hopper for connection to a paintball launcher or marker has a counter which includes a flexible potentiometer extending into a transfer conduit that connects to the paintball launcher or marker. The hopper has a reservoir shaped for movement of the paintballs toward the transfer conduit. The hopper has a nose with slanted surfaces that are deflection engineered to enhance the deflectability of paintballs directed at the user. The counter mechanism includes a timer and an LCD display so the user can see how many paintballs have been launched and monitor time. The hopper also includes an agitator to agitate the paintballs in the reservoir.

14 Claims, 10 Drawing Sheets

PAINTBALL HOPPER

This application claims the benefit of U.S. Provisional Application Ser. No. 60/202,488 filed May 5, 2000.

BACKGROUND OF THE INVENTION

1. Field of the Invention

This invention relates to hoppers that contain a supply of paintballs for delivery to a paintball launcher or weapon that delivers the balls of paint that explode upon impact.

2. State of the Art

In the game or sport of paintball, a participant has a paintball launcher that is activated by the participant to launch a ball of paint at a notable speed (e.g., about 150 to 200 feet per second) so that it can be likened to a bullet or similar projectile. Paintballs are generally spherical with a skin having paint therein. The skin is flexible and can break (explode) on impact.

The launcher is sometimes referred to as a marker and may be likened to a gun or similar weapon because it has a barrel and a trigger. The paintball is positioned in a chamber and may be launched or ejected from the chamber by operating the trigger to port high pressure gas to urge the paintball down and out the barrel. In order to provide an automatic fire or a repeater feature, a paintball hopper or reservoir is associated with the launcher to supply paintballs on demand in a one by one sequence to the chamber from which the paintballs are launched. U.S. Pat. No. 5,282,454 (Bell, et al.) illustrates and describes one such hopper which has a mechanism to agitate or stir the paintballs in the hopper to eliminate a jam as the paintballs move toward a discharge from the hopper for supply to the launcher. An infrared sensor notes the absence of a paintball in a supply tube to the launcher and sends a signal to operate the mechanism to agitate or stir the paintballs in the hopper and in turn eliminate any jam.

A hopper formed to enhance deflection of incoming paintballs and at the same time count paintballs and provide the user with time information is not known. A hopper configured to count paintballs passing to the launcher is also not known.

SUMMARY OF THE INVENTION

A hopper for dispensing paintballs to a paintball gun has a reservoir with a reservoir discharge formed in it through which paintballs exit. The reservoir is sized to receive and retain a plurality of paintballs preferably in selected or desired amounts such as 200 paintballs. The reservoir is shaped for directing movement of the paintballs by gravity toward the reservoir discharge.

A transfer conduit has a proximal end connected to the reservoir discharge to receive paintballs from the reservoir discharge. The transfer conduit has a distal end formed for connection to a paintball launcher. The transfer conduit is sized and shaped for supplying the paintballs in one by one sequence to the launcher for ejection or launching by the launcher. Preferably, the transfer conduit is a tubular structure having an inside diameter selected for the passage of one paintball at a time therethrough.

A counter mechanism for counting each paintball moving through said transfer tube is attached to the transfer conduit. The counter mechanism 34 has a power supply for supplying electrical energy to the several components that are electrically operated. An on-off switch is positioned to be operable by the user and configured to interconnect the power supply to and to disconnect the power supply from components of the counter mechanism. The counter mechanism also has counting means positioned to extend into the transfer conduit to operate between a first position in which no paintball is present in the transfer conduit proximate the counting means and a second position in which a paintball is passing proximate the counting means in transit from the proximal end toward the distal end of the transfer conduit. The counting means is configured to supply detection signals reflective of the presence of each transiting paintball.

The counter mechanism also includes interface means connected to the power supply to receive electrical energy and to the counting means to supply electrical energy. The interface means also is connected to the counting means to receive the detection signals. The interface means is configured to generate count signals reflective of or for the passage of each paintball through the transfer conduit.

The counter mechanism also has control means connected to receive electrical energy from the power supply. The control means is also connected to the interface means to receive the count signals. The control means is configured to process the counting signals and to supply image signals reflective of the count of paintballs passing through the transfer conduit.

The counter mechanism preferably has a timer for generating and supplying time signals reflecting time measured from a reference. Timer controls are positioned for operation by a user and connected to supply timer control signals to activate, deactivate and reset the timer to a reference time which is preferably zero time.

An LCD display is positioned for observation by a user of the launcher and is connected to receive the image signals from the control means and the time signals from the timer. The LCD display is configured to convert the image signals to visually perceivable images reflecting the count of paintballs passing through the transfer conduit and to convert the time signal to a visually perceivable image of time. In alternate arrangements, the time shown may be actual chronological time or elapsed time.

Preferably, the counting means is a flexible potentiometer having a proximal end secured to the wall of said transfer conduit and a distal end extending into said transfer conduit for contact and deflection by a paintball transiting from the proximal end to the distal end of the transfer conduit. In a more preferred arrangement the reservoir includes agitation means positioned in the hopper proximate the discharge. The agitation means is connected to the power supply and operable to agitate paintballs in the reservoir to facilitate movement of the paintballs into the transfer conduit and in turn through the discharge.

An alternate embodiment of a hopper for dispensing paintballs to a paint launcher includes a reservoir having an interior, and an exterior. A reservoir discharge through which paintballs exit the reservoir is formed into the interior to receive paintballs and to pass them into a transfer conduit attached to extend away from the hopper for connection to the paintball launcher. The reservoir is sized to receive and retain a plurality of paintballs. The interior is shaped for directing movement of the paintballs by gravity toward the reservoir discharge. The exterior of the hopper is shaped to enhance deflection of a paintball having a trajectory toward the paintball hopper.

In a preferred arrangement of the alternate embodiment, the reservoir has a first cross section spaced from a second cross section. The second cross section being formed to be larger than the first cross section with the first cross section being oriented away from the user in use and the second cross section is oriented toward the user in use. Most preferably, the hopper has a nose with faceted sides extending backward therefrom to a large diameter which is about where the transfer conduit extends away from the reservoir. The hopper is also formed with an ornamental design as shown and described.

DESCRIPTION OF ILLUSTRATED EMBODIMENTS

Figure 1:
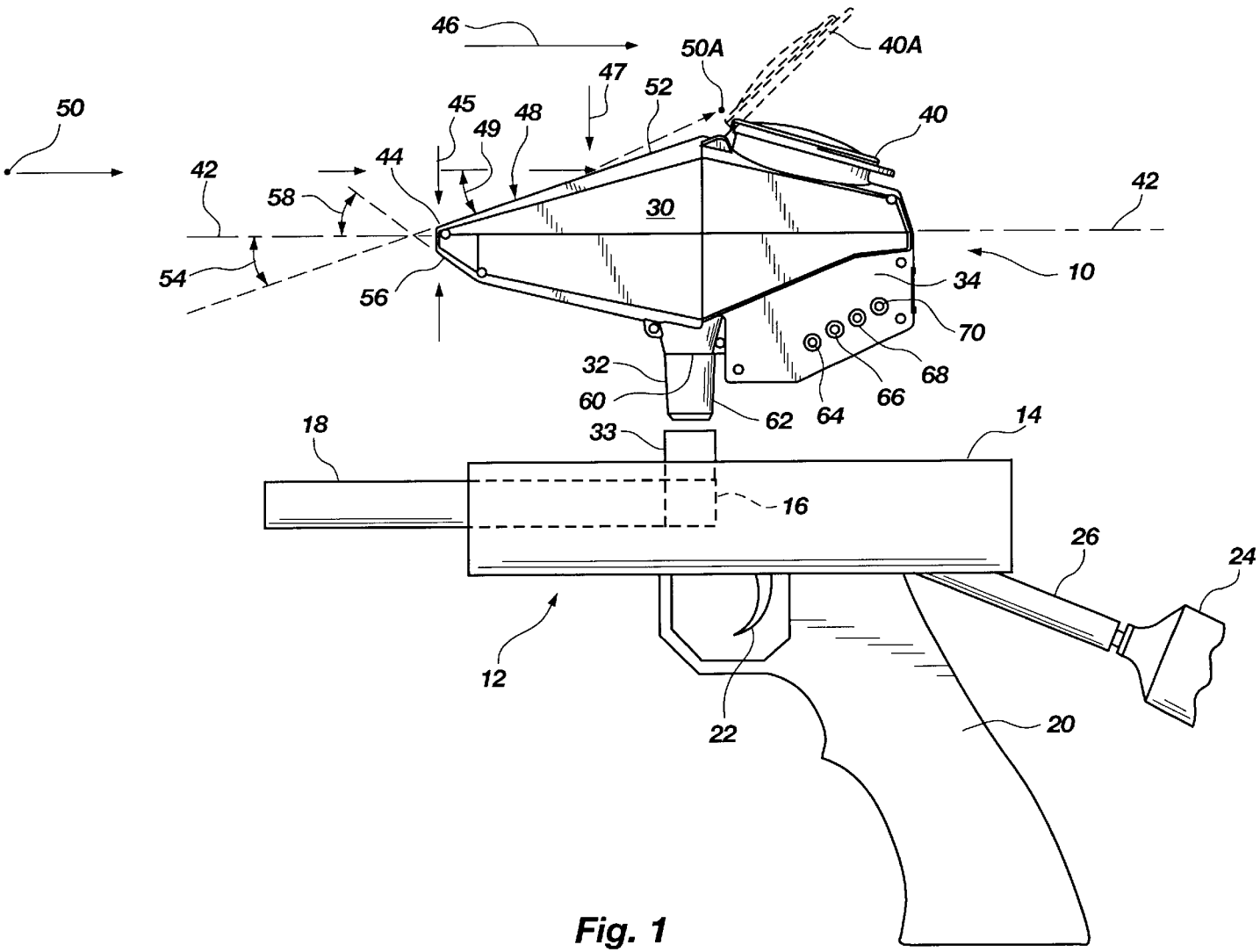
FIG. 1 is a depiction of a paintball hopper positioned for association with a paintball launcher.

FIG. 1 shows a paintball hopper 10 positioned for connection to or association with a paintball launcher which is here depicted as paintball gun 12. The gun 12 is shown with a housing 14 that contains a chamber 16 configured to receive paintballs and from which the paintballs are launched for travel through and out of barrel 18 toward a target selected by the user. The gun 12 is operated by grasping the handle 20 and manipulating the trigger 22 to port compressed gas (e.g., compressed carbon dioxide) from a cylinder 24 connected to supply the gas upon demand via a tube 26.

The hopper 10 has a reservoir 30 which is sized to hold a quantity of paintballs (e.g., 76, 77 in FIG. 2) for delivery to a transfer conduit 32. As presently sized, the hopper 10 may contain about 200 paintballs. The hopper 10 may also be sized to contain from about 125 paintballs to about 300 paintballs. The hopper 10 has a counter mechanism 34 for counting paintballs and to perform other functions as more fully described hereinafter. The hopper 10 also has a top 36 (FIG. 2) which has a loading opening 38 formed in it through which paintballs may be loaded. The loading opening 38 is covered by a lid 40 which operates between a closed position shown in solid and an open or load position 40A shown by dotted lines (FIG. 1).

The hopper 10 has a longitudinal axis 42 with the reservoir 30 formed or shaped to enhance deflection of a paintball directed at or toward the user from another launcher. The reservoir 30 is in effect engineered to enhance deflection or deflection engineered. The reservoir has a nose 44 which has a cross section 45 that is relatively small in relation to the cross section 47 of the reservoir 30 rearward 46 of the nose 44. Thus, the exterior 48 of the reservoir 30 has one or more slanted surfaces oriented or engineered to enhance deflection of paintballs directed at the user. It is believed that some paintballs directed toward the hopper 10, like paintball 50, will not break, but rather skip or bounce away from the external surface 48. Specifically a paintball 50 of a particular trajectory will have an angle of incidence 49 so that the skin of the paintball 50 does not break as the paintball 50 comes in contact with the surface 48. In short, the paintball 50 may not break, but skip off as illustrated at 50A.

The angle of incidence 49 may vary with factors including the thickness of the paintball skin, velocity of the paintball, air currents, and other empirical factors. In certain paintball games, a point, score, or equivalent is earned by the user who hits an opponent with a paintball as evident because the paintball breaks on an opponent or on the opponent's equipment. With a skip or deflection, the point, score, or equivalent is not earned. Thus, a user of the disclosed paintball hopper 10 has an improved opportunity to avoid paintballs directed at him during a game in which opponents direct paintballs at each other.

Looking at FIG. 1, it can be seen that a surface 52 of the exterior 48 has an angle 54 which is selected to be less than about 30 degrees and preferably about 15 degrees as measured from the longitudinal axis 42. Another surface 56 is at an angle 58 which is selected to be less than 45 degrees and preferably about 35 degrees. The exterior 48 is here shown to have multiple or faceted surfaces deflection engineered as hereinafter discussed. However, it should be understood that the hopper could be conical with one exterior slanted or angled surface. The hopper could also have any arrangement of exterior surfaces so long as they are presented at an angle like angle 54 to facilitate deflection or bouncing of paintballs directed at a user.

The transfer conduit 32 of the hopper 10 in FIG. 1 has a proximal end 60 connected to the discharge 74 (FIG. 2) of the reservoir 30 as discussed hereafter. The transfer conduit 32 has a distal end 62 which is tapered for ease of connection to a receptacle 33 of the launcher or gun 12 which interconnects to the chamber 16. Thus, paintballs can proceed from the reservoir 30 into and down through the transfer conduit 32 to the launcher such as gun 12.

The counter mechanism 34 (FIG. 1) is shown appended to and in turn part of the hopper 10. The counter mechanism 34 has operating buttons positioned for easy access by the user. The buttons include an on-off button 64 and a reset button 66 which when pressed resets to zero the counter for counting paintballs. Also included is a minutes-timer button 68 which turns the minutes timing function of the timer on and off as desired when operated. Similarly, there is a seconds timer button 70 which is operable to turn off and turn on the seconds function of the timer.

Figure 2:
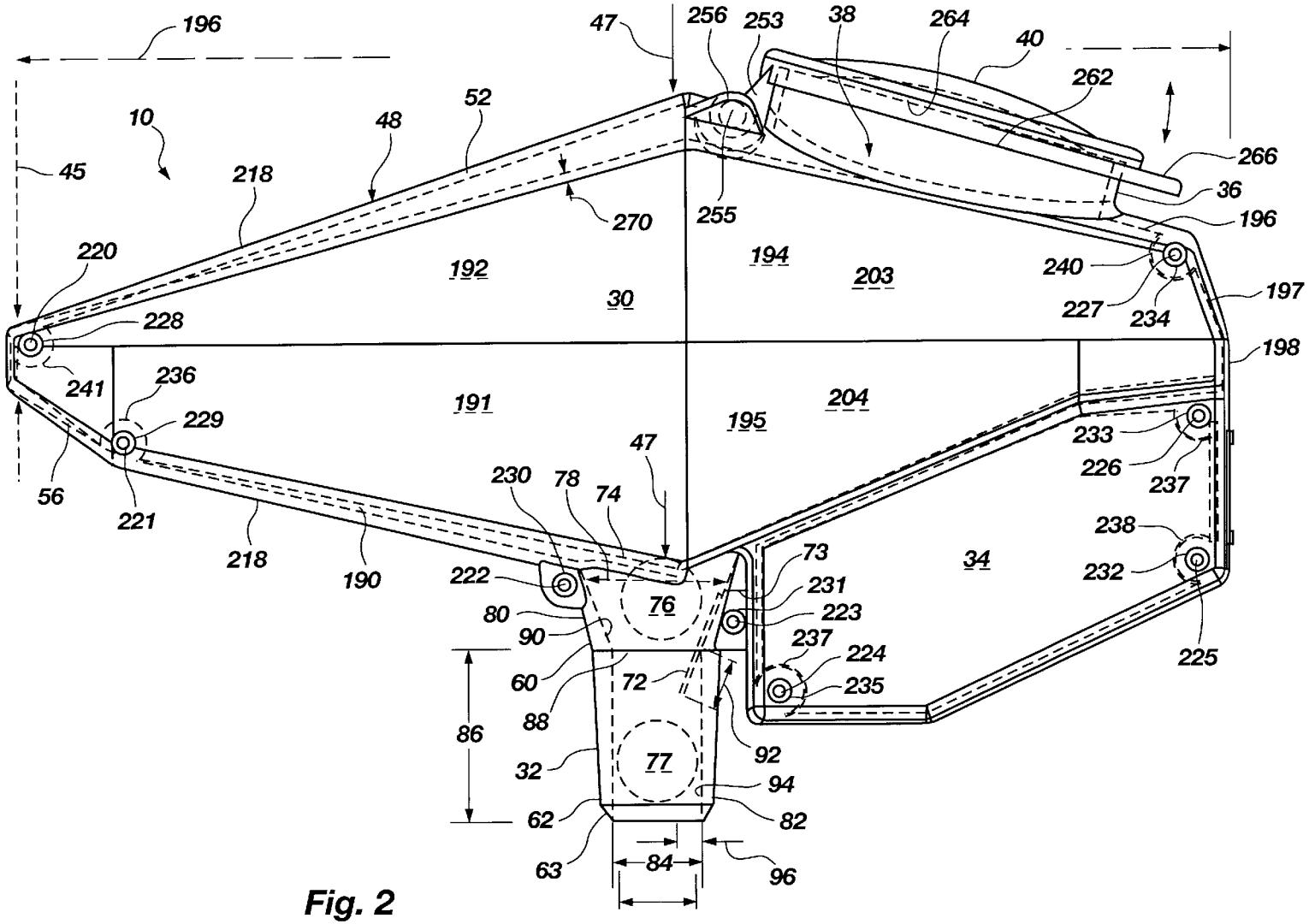
FIG. 2 is a side view of a hopper of the present invention.

In FIG. 2, the hopper 10 is shown in greater detail including a flexible potentiometer 72 of the type illustrated and described in U.S. Pat. No. 5,157,372 (Langford) the disclosure of which is incorporated herein by this reference. The flexible potentiometer 72 is positioned to extend into the transfer conduit 32 and is connected mechanically or by a conductor such as conductor 73 to the counter mechanism 34 as discussed more fully hereinafter.

The transfer conduit 32 has its proximal end 60 connected to the discharge 74 of the reservoir 30. The discharge 74 (FIG. 2) may be any opening from the interior of the reservoir 30 into the transfer conduit 32 so that paintballs such as paintball 76 and 77 may proceed from the reservoir 30 into the transfer conduit 32. Preferably the discharge 74 is circular and has the same diameter or a diameter that is slightly less than the diameter 78 of conical section 80 of the transfer conduit 32.

The conical section 80 of the transfer conduit 32 extends to a tubular section 82 which has a substantially constant inside diameter 84 along its length 86. The distal end 62 of the transfer conduit 32 has a taper or angle 63 to facilitate insertion of the transfer conduit 32 into receptacle 33 of the launcher or gun 12. A lip or rim 88 is formed at the transition from the conical section 80 of the transfer conduit 32 to the tubular section 82. The flexible potentiometer 72 is sized in length to extend along at least a portion of the conical inside surface 90 and over the lip or rim 88 into the tubular section 82 a distance 92 selected to be from about one fourth (¼) to one half (½) the diameter 84 so that the flexible potentiometer 72 extends away from the interior side wall 94 a distance 96 that is from about one eighth (⅛) to about one fourth (¼) the diameter 84 of the tubular section 82. The distance 96 and the length 92 may vary and are selected so that the flexible potentiometer 72 will bend or deflect as each paintball of a stream or series of paintballs (e.g., paintballs 76, 77) passes down the tubular section 82. Notably the flexible potentiometer 72 includes a substrate made of a semi rigid and deflectable film (e.g., Kapton® insulator, mylar) with a conductive material, such as a carbon based compound, placed (e.g., screened) thereon. When the substrate bends or deflects the carbon based compound also bends and in turn the electrical resistance of the conductive material will vary as the substrate is bent or deflected in a detectable and predictable amount related to the flexure. That is, the flexible potentiometer 72 bends or deflects as each paintball (e.g., paintballs 76, 77) passes causing a change in resistance that is a detection signal reflecting the passage of one paintball. After the paintball has passed, the flexible potentiometer returns to its non deflected condition. Thus, the counting can be regarded as a change in electrical signals as the flexible potentiometer 72 changes from a non deflected condition to a deflected condition.

Figure 3:
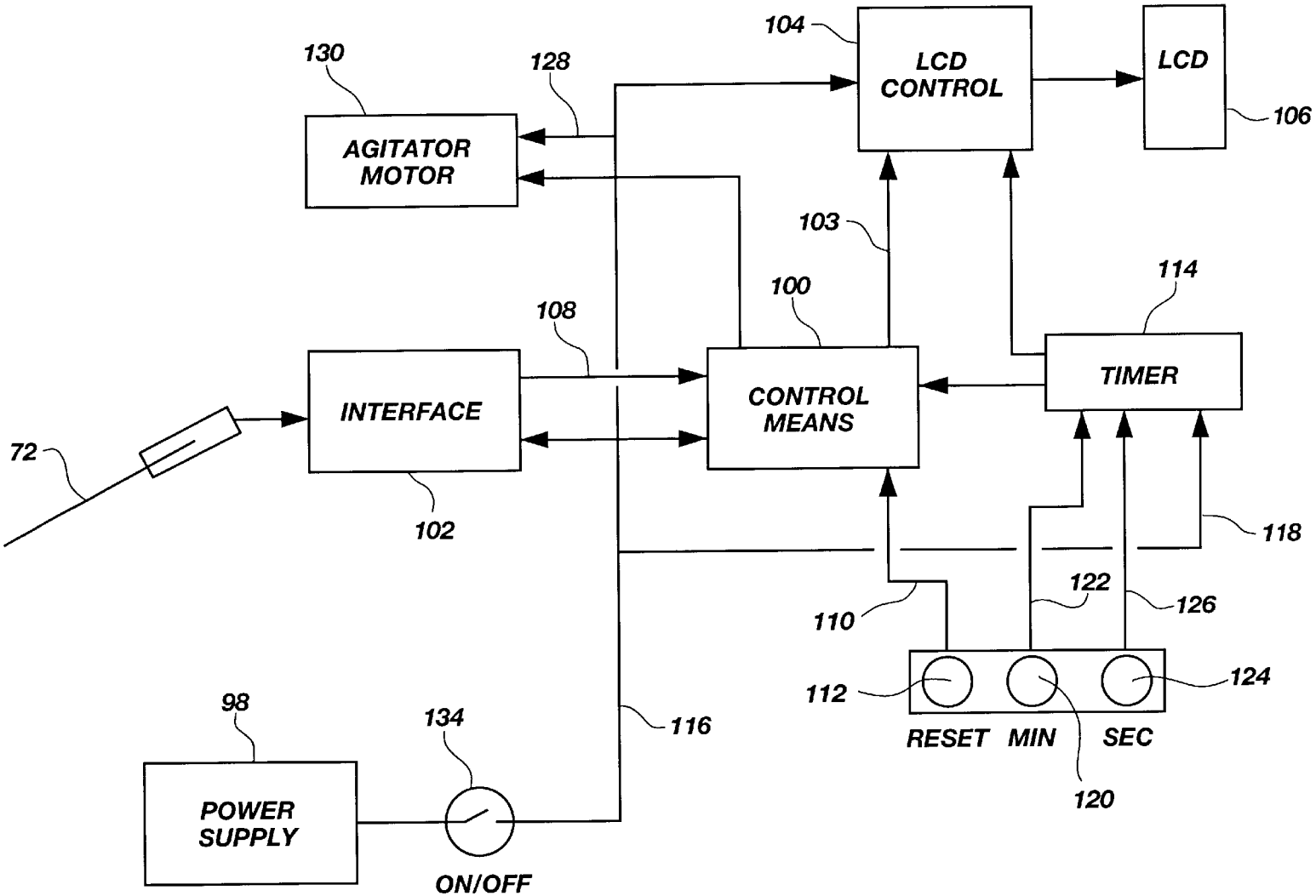
FIG. 3 is a block diagram of electrical controls for use with the paintball hopper of the present invention.

Turning to FIG. 3, a block diagram of the counter mechanism 34 shows a power supply 98 connected to supply power to the control means 100, to the flexible potentiometer 72 through interface circuit 102, to an LCD control 104 and an LCD 106. A detection signal is supplied to the interface circuit 102 by the flexible potentiometer 72 which detection signal is reflective of the deflection of the flexible potentiometer 72 as each paintball passes down the transfer conduit 32 from the proximal end 60 toward the distal end 62. The interface circuit 102 has an output 108 which is a count signal for each paintball 76, 77 passing and deflecting the flexible potentiometer 72. The detection signal and in turn the count signal may also reflect the absence of a paintball or an empty reservoir 30.

The control means 100 is connected to receive and process the count signals via output 108. The control means 100 is any suitable circuit configured to receive the count signals from the interface circuit 102 and to supply image signals by conductor 103 to the LCD control circuit 104 which in turn causes images visible to a user to be presented on the LCD screen 106. Preferably the control means 100 includes a commercially available microprocessor chip that is configured to effect the counting and reset functions here discussed. The images on the screen are in fact cardinal numbers reflecting the number of paintballs that have transferred from the reservoir 30 to the gun 12. The control means 100 may also supply a low battery signal to the LCD control 104 to cause a visible image reflecting a low battery condition to be displayed on the LCD 106.

The control means 100 is configured to receive a reset signal via conductor 110 from a reset button 112. The reset signal directs the control means to reconfigure and present a "zero" paintball count or some other agreed image. In turn the user will have a point from which to start counting paintballs discharged by the launcher or gun 12.

The counter mechanism 34 also includes a timer 114 (FIG. 3) connected to receive power from the power supply 98 via conductors 116 and 118. The timer 114 also receives a start-stop signal from button 120 via conductor 122 to start and stop the timer 114 generating a "minute" signal. Similarly, the timer 114 receives a start-stop signal from button 124 via conductor 126 to start and stop the time 144 generating a "seconds" signal. The minutes and seconds are then counted and, after starting, are presented as changing numbers displayed by the LCD 106. Although the timer 114 presents time relative to starting and stopping, it should be understood that a timer 114 may be selected to present a separate real time signal or a separate relative signal.

The counter mechanism 34 also supplies power from the power supply 98 via conductor 116 to conductor 128 and to a motor 130 configured to rotate an agitator 132 (FIG. 4) which in turn moves paintballs in the hopper 10 to reduce or minimize jamming. The power from the power supply 98 may be turned on and off by a switch 134.

Figure 4:
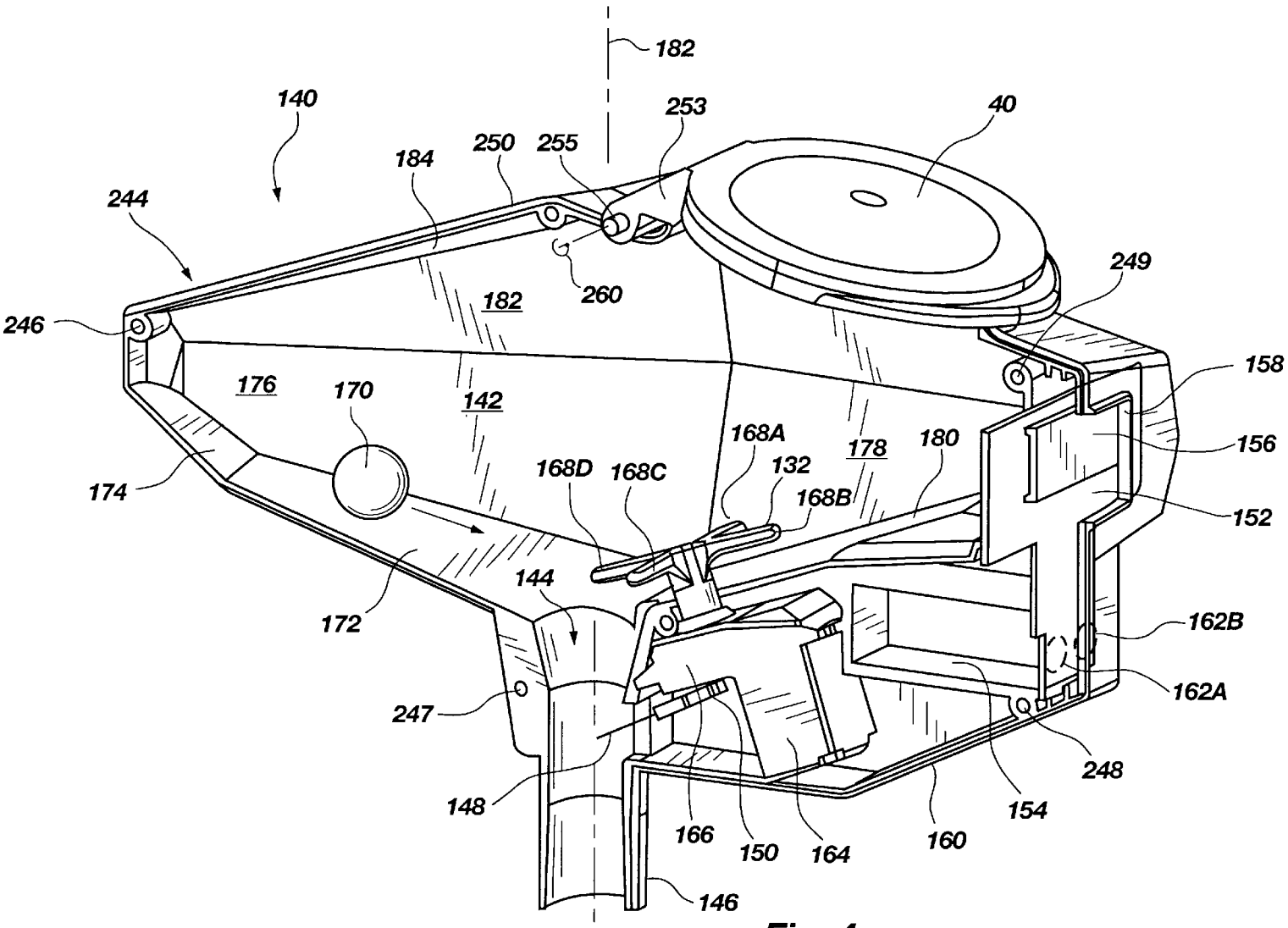
FIG. 4 is a side perspective with portions removed of an alternate paintball hopper of the present invention.
Figure 5:
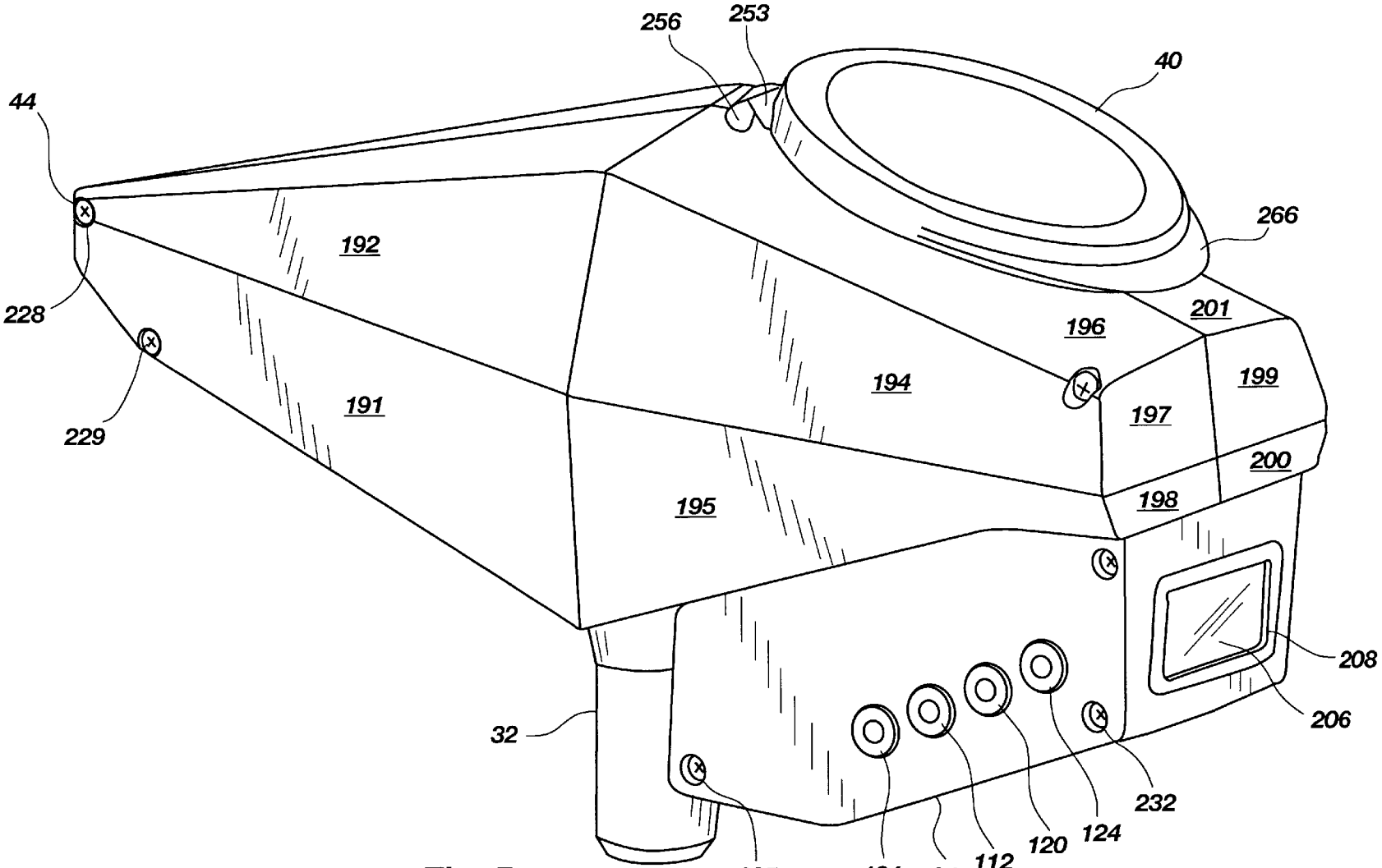
FIG. 5 is an upper rear perspective view of the hopper of FIG. 1.
Figure 6:
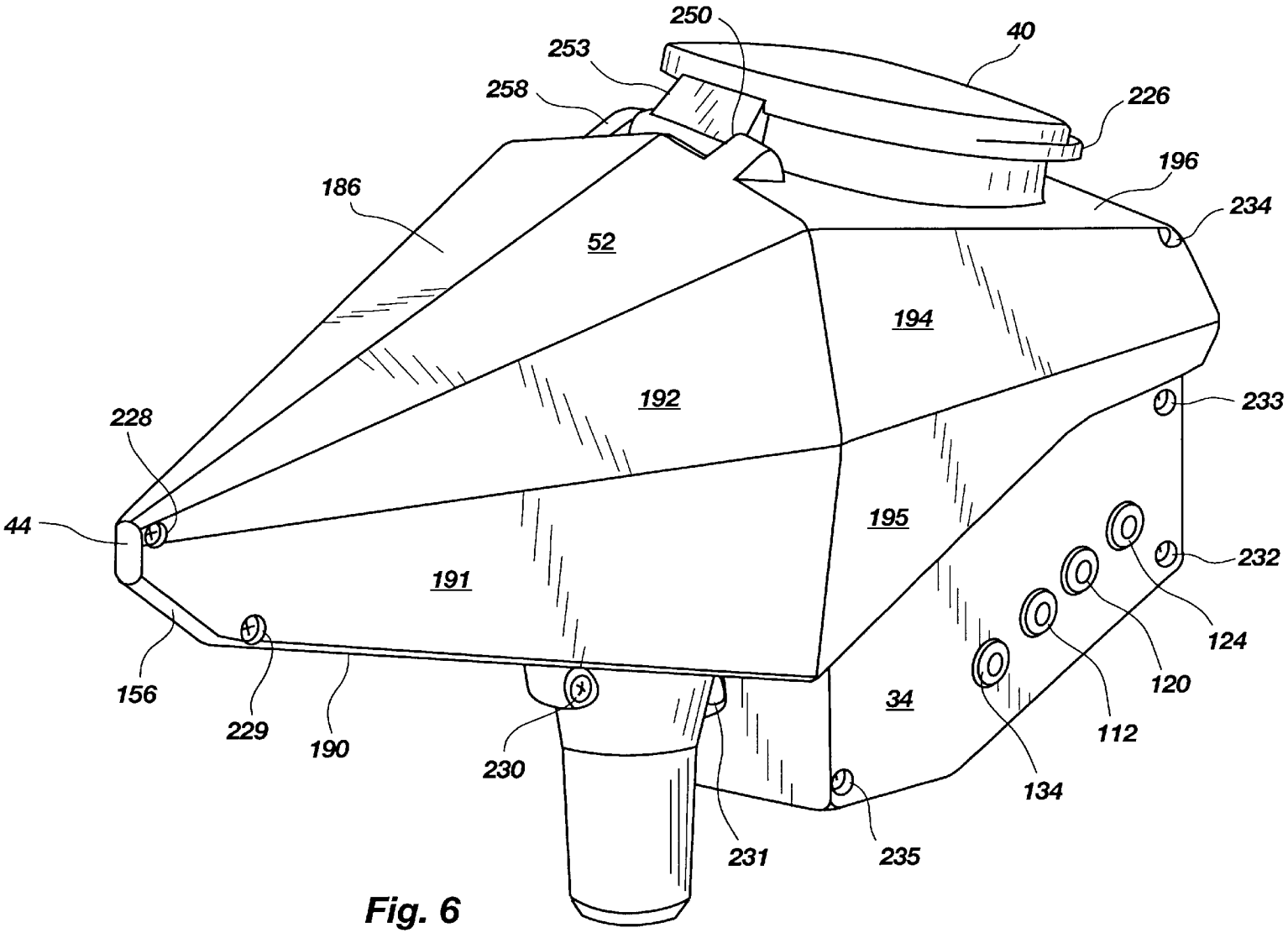
FIG. 6 is an upper front perspective view of the hopper of FIG. 1.
Figure 7:
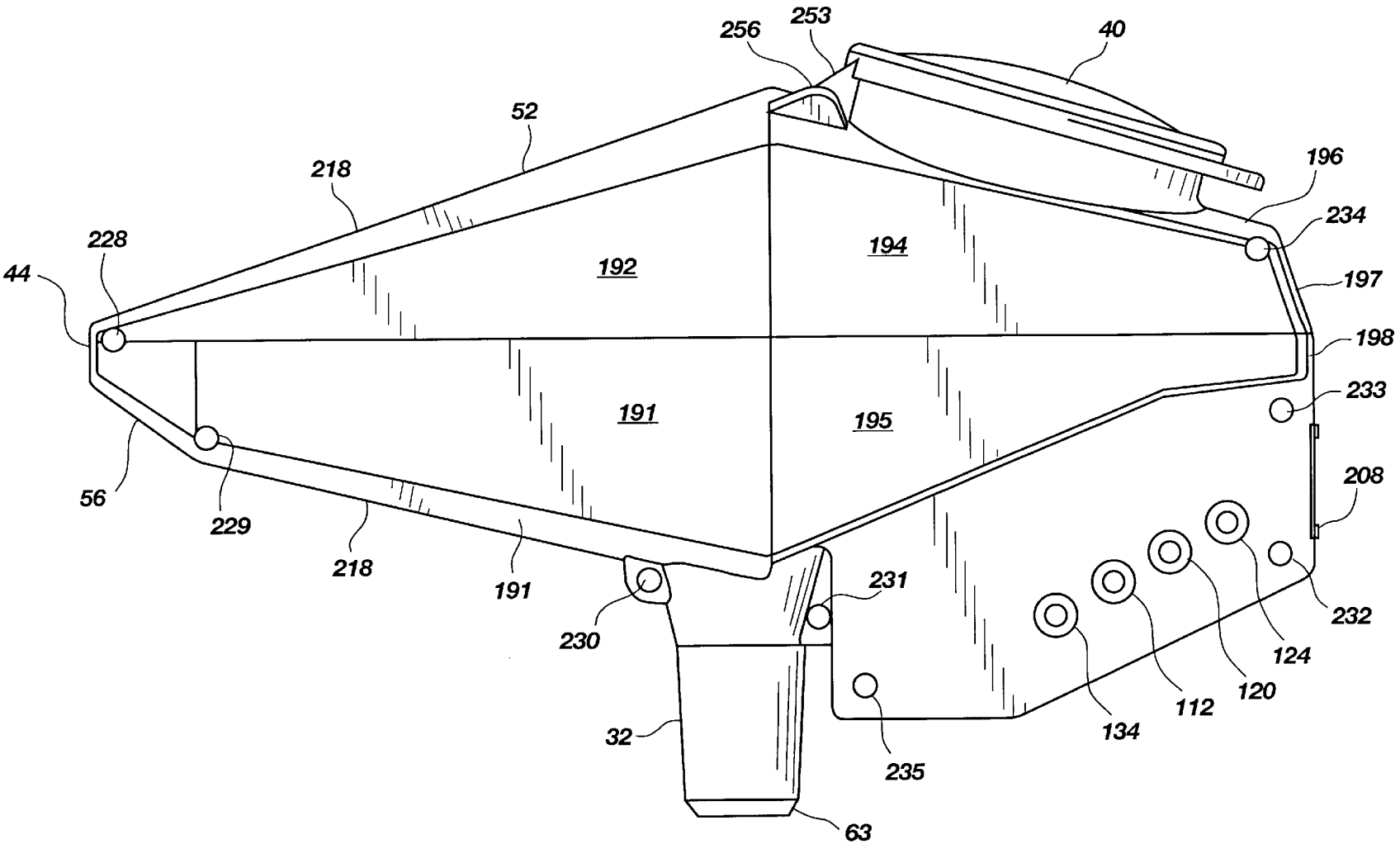
FIG. 7 is a side plan view of the hopper of FIG. 1.
Figure 8:
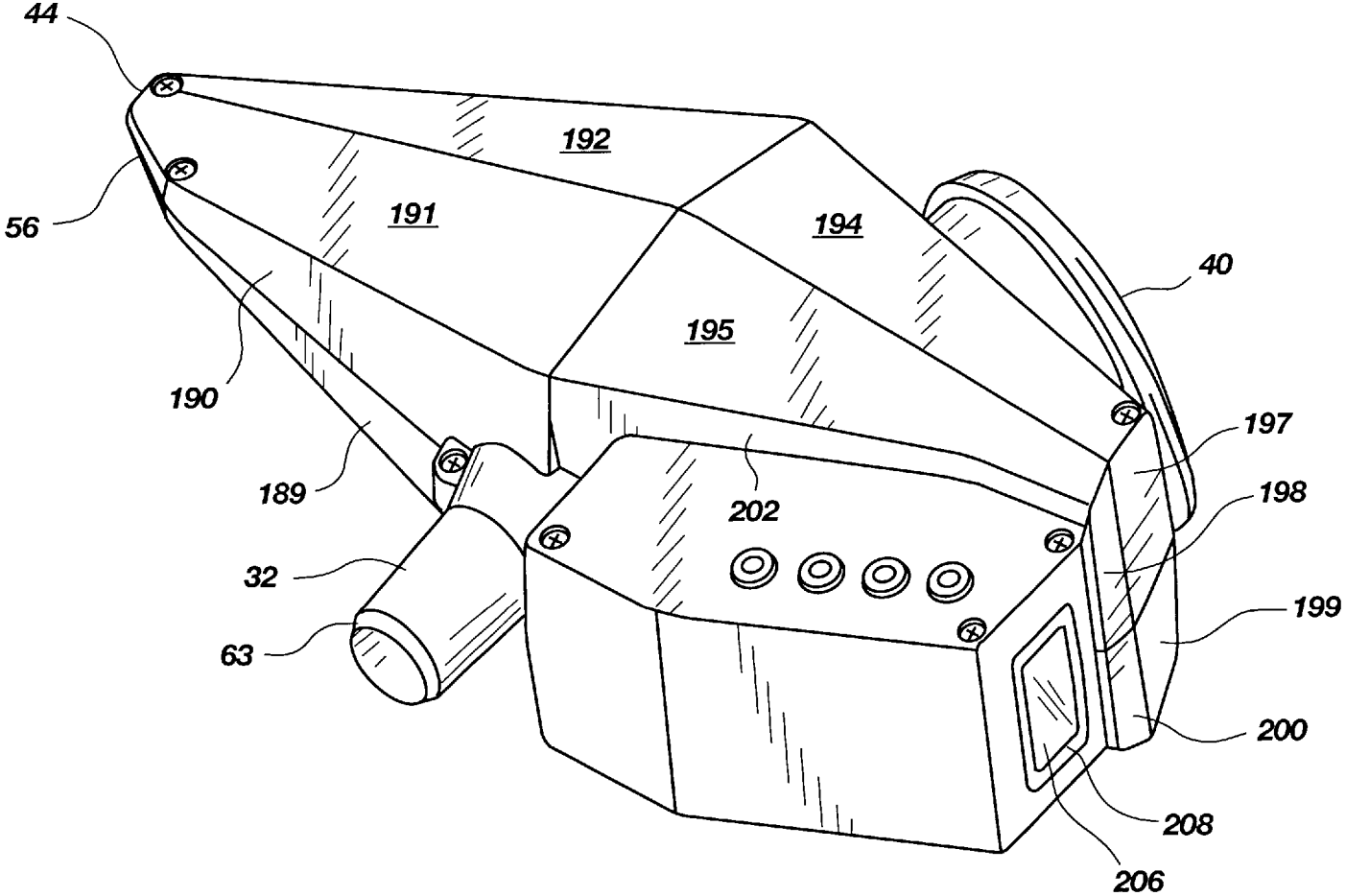
FIG. 8 is a bottom rear perspective view of the hopper of FIG. 1.
Figure 9:
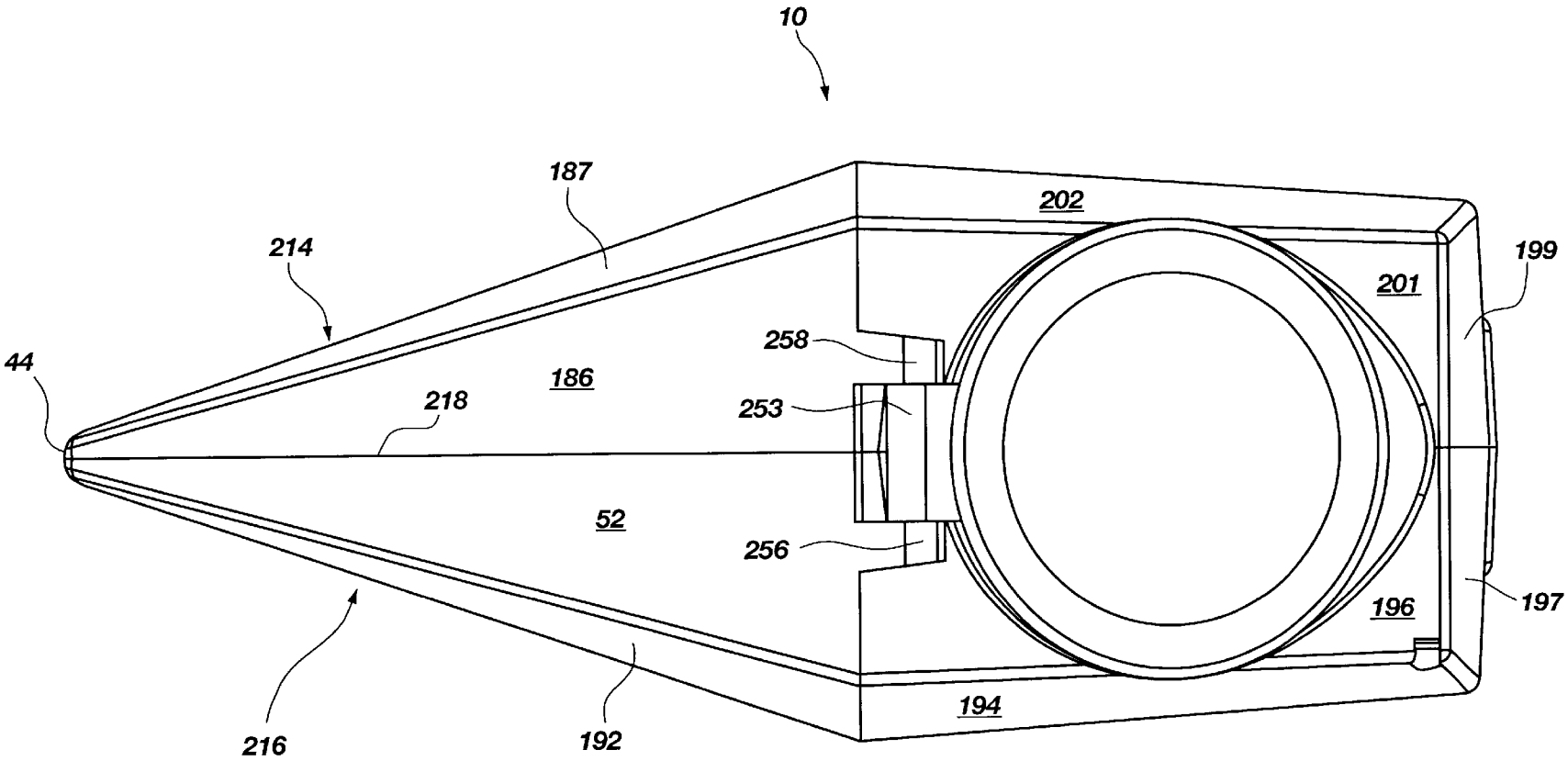
FIG. 9 is a top plan view of the hopper of FIG. 1.
Figure 10:
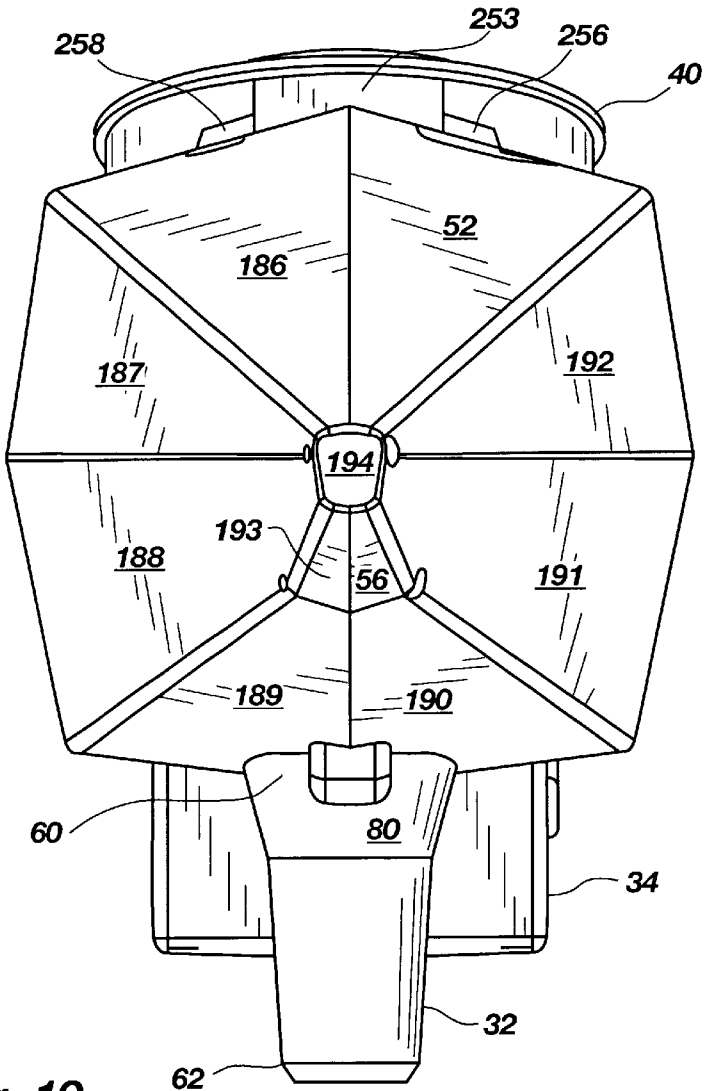
FIG. 10 is a front plan view of the hopper of FIG. 1.

FIG. 4 shows a hopper 140 very similar to hopper 10. Hopper 140 has a reservoir 142 sized to hold 200 standard paintballs of the type suitable for use in a paintball gun such as gun 12. The hopper may also be sized to hold from about 125 to about 300 paintballs. The paintballs move from the reservoir 142 through a discharge 144 into a transfer conduit 146 which is substantially the same as transfer conduit 32 (FIGS. 1 and 2). In FIG. 4, the flexible potentiometer 148 is shown extending into the transfer conduit 146 to be deflected by each paintball moving though the discharge 144 into and down the transfer conduit 146. The flexible potentiometer 148 is attached to and connected to an interface circuit 150 (comparable to interface circuit 102) which functions to supply detection signals to a control means (similar to control means 100) formed with and on a printed circuit board 152. A battery housing 154 sized to accept one or more standard batteries is provided and connected the same as the power supply 98 of FIG. 3.

The printed circuit board 152 has a timer and an LCD (liquid crystal display) control all mounted to and on it to effect an arrangement illustrated in FIG. 3. An LCD 156 is shown positioned for viewing through a small window formed with a piece of transparent plastic like plexiglass positioned to seal the counter mechanism 160. Portals 162A and 162B may be provided to insert and remove batteries into and out of the battery housing 154.

The battery housing 154 with batteries (not shown) function as a power supply to drive the agitator motor 164 which is connected by a gearing arrangement 166 that drives the agitator 132. The agitator motor 164, gearing arrangement 166 and agitator 132 are essentially the same for the hopper 140 and the hopper 10.

The agitator 132 is shown with 4 arms 168A–D that rotate within the reservoir 142 to push or urge paintballs to move and align over the discharge 144. That is, paintballs may jam or clog at or near the discharge 144. The arms 168A–D extend over the discharge 144 to dislodge paintballs that may be jammed at or near the discharge 144 and allow others to roll or slide through the discharge 144 into the transfer conduit 146. The motor 164 is preferably a high rpm (e.g., 1200 to 5000 rpm) low torque motor that rotates the gearing arrangement 166 which functions as a reduction gear so that the agitator 132 rotates very slowly (e.g., 0.5 to 3 rpm). The motor 164 may be a continuously rotating motor or a stepping motor that operates intermittently in a repetitive cycle to conserve the battery. In a preferred arrangement, each time a ball is counted, the control means 100 supplies a signal to the motor 164 to cause it to operate and cause the agitator to rotate for a preselected time (e.g., 1 to 5 seconds) at a rotation rate that may be from about one half to three revolutions per minute.

In FIG. 4, a paintball 170 is shown in phantom and directed toward the discharge 144 by the sloped surface 172. The reservoir 142 has several sides such as sides 172A, 174A, 176A, 178A and 180A that have inside surfaces 172B, 174B, 176B, 178B and 180B which are all shown sloped toward the discharge 144. Thus, when the hopper 140 is held with its vertical axis 182 generally vertical or upright, the paintballs within the reservoir 142 will all be urged by gravity toward the discharge 144. At the same time, the sides 172A, 174A, 176A and 178A reflect a shape to enhance deflection of paintballs directed at the hopper 140 and its user as part of any one of several paintball games or contests. Upper sides 182A and 184A have inside surfaces 182B and 184B are angulated to enhance the deflection of paintballs as hereinbefore discussed with respect to hopper 10 in FIG. 1.

Of course there are surfaces that correspond to or effectively mirror surfaces 172B, 174B, 176B, 178B, 182B and 184B that are not shown in FIG. 4 to facilitate illustration.

In FIGS. 1 and 2, the paintball hopper 10 is shown as a faceted structure with single or one piece side members that present both the internal surfaces to define the reservoir 30 and the external surfaces 48 shaped or deflection engineered to enhance the deflection of paintballs directed at the hopper 10 and its user. The several external surfaces 52, 56, 186–194 are shown in FIGS. 5–10 to show that the hopper 10 has an aerodynamic-like shape or form presenting in effect a cross section 44 that is small at the nose 295 increasing to the cross section 47 rearward at a position rearward and preferably more than half of the overall length 296 of the hopper 10.

To present a streamlined appearance and present angled surfaces when the hopper 10 is positioned in other orientations, the hopper 10 has multiple external surfaces 194–202 and surfaces 203 and 204 shown in dotted line to reflect that each is a mirror of surfaces 194 and 195 respectively but opposite and abutting or adjoining surfaces 199 and 200 respectively.

In comparing the embodiment of FIGS. 1, 2 and 5–10 with the embodiment of FIG. 4, it can be seen that the external structure is virtually the same except for the location of the LCD 156 and the window 158 in FIG. 4 and the location of the LCD 206 and LCD window 208 in the embodiment of FIGS. 1, 2 and 5–10. The shape of the counter mechanism 34 in the embodiment of FIGS. 1, 2 and 5–10 in the area proximate the transfer conduit 32 also differs from the shape of the counter mechanism 160 in the area proximate the transfer conduit 146.

To construct the hoppers 10 and 140, it is presently intended to create molds so that each hopper 10 and 140 may be formed from two opposite halves that are separately molded from polypropylene or some other suitable light weight material that may be from any one of several lightweight and strong metals but is preferably plastic-like to limit or control cost. Wall thickness 270 is sufficient to retain structural rigidity but limited to keep the weight of the hoppers 10 and 140 as low as possible. In various games, the user is carrying and aiming the launcher 12 with the hopper 10, 140 attached. A light assembly is generally preferred to avoid tiring the user's arm. After formation, the opposite halves are then joined together. That is, hopper 10 is formed from half 214 and half 216 which are joined together and abut each other to form seam 218. The halves 214 and 216 are held together by screws 220–227 that extend through appropriate apertures 228–235 formed in half 216 into screw receptacles 236–241 and receptacles for screws 222 and 223 that are not clearly illustrated.

Only one half 244 of hopper 140 is shown in FIG. 4. The other half is not shown for clarity but will effectively mirror half 244 and abut it to form a seam along edge 250 similar to seam 218. The halves of hopper 140 will be joined together by any suitable means such as screws that connect through holes into to receptacles 246–249. It should be understood that additional screws and receptacles may be used as desired to effect a secure connection of the two halves of hopper 140 as well as hopper 10. Similarly it should be understood that other means of securing the halves of hopper 140 and the halves 214 and 216 of hopper 10 together. Nut and bolt arrangement, snap connectors or force fit arrangements are all contemplated as suitable. The securement of halves such as halves 214 and 216 as well as half 244 preferably allows for disconnection or disassembly from each other or its other half to allow a user to clean the interior of the hopper should a paintball break before use.

It may be noted that the embodiment of FIGS. 1, 2 and 5–10 as well as the embodiment of FIG. 4 each have a substantially identical lid 40. The lid is rotatably mounted to its respective hopper 10, 140 by hinge member 253. A hinge bar 255 extends through hinge brackets 256 and 258 formed unitarily with the hoppers 10 and 140 to extend outwardly. An appropriate locking ring 260 (FIG. 4) may be used on the outer ends of the hinge bar 255 to hold the hinge bar 255 in place. The lid 40 rotates between a closed and open 40A position (FIG. 1). When in the closed position, the lid 40 is held securely in place by a ridge 262 (FIG. 2) about the rim 264 of the loading opening 38 with a snap ridge (not shown) on the lid to create a friction and mechanical securement. The lid 40 has a lever 266 formed integrally therewith for manipulation by the user to effect opening and closing of the lid 40.

In specific reference to FIGS. 4–10, it can be seen that the various surfaces abut others surfaces. The edges formed by the abutment are rounded or formed with a radius to enhance the deflectability of incoming paintballs while eliminating the risks associated with straight sharp edges.

Those skilled in the art will recognize that the embodiments discussed herein above are merely reflective of the principles of the inventions which are defined by the claims. The details of the embodiments are not intended to limit the scope of the appended claims.

What is claimed is:

1. A hopper for dispensing paintballs to a paintball launcher, said hopper comprising:

a reservoir having a reservoir discharge through which paintballs exit said reservoir, said reservoir being sized to receive and retain a plurality of paintballs;

a transfer conduit having a proximal end connected to said reservoir discharge to receive said paintballs from said reservoir discharge, said transfer conduit having a distal end formed for connection to said paintball launcher and said transfer conduit being sized and shaped for supplying said paintballs in one by one sequence to said paintball launcher;

a counter mechanism for counting each paintball moving through said transfer tube, said counter mechanism including:

counting means positioned to operate between a first position in which no paintball is present in said transfer conduit proximate said counting means and a second position in which a paintball transiting from said proximal end to said distal end of said transfer conduit is in said transfer conduit proximate said counting means, said counting means being configured to supply detection signals reflective of the presence of each paintball proximate said counting means, interface means connected to said counting means to receive said detection signals, said interface means being configured to generate counting signals reflective of the passage of each paintball through said transfer conduit, control means connected to said interface means to receive said counting signals, said control means being configured to process said counting signals and to supply image signals reflective of the count of paintballs passing through said transfer conduit, and a display connected to receive said image signals from said control means, said display being configured convert said image signals to visually perceivable images reflecting the count of paintballs passing through said transfer conduit.

2. The hopper of claim 1 wherein said reservoir has a longitudinal axis, an interior, and an exterior, said interior being shaped for directing movement of said paintballs toward said reservoir discharge, and wherein said exterior is formed to have at least one surface with a surface axis oriented to intersect said longitudinal axis at an angle from about 15 degrees to about 30 degrees measured from said longitudinal axis to said surface axis.

3. The hopper of claim 1 wherein said reservoir has a longitudinal axis, an interior, and an exterior, and wherein said exterior is formed of a plurality of faceted surfaces at least one of which has a surface axis oriented to intersect said longitudinal axis at an angle from about 15 degrees to about 30 degrees measured from said longitudinal axis to said surface axis.

4. A hopper for dispensing paintballs to a paintball launcher, said hopper comprising:

a reservoir having a reservoir discharge through which paintballs exit said reservoir, said reservoir being sized to receive and retain a plurality of paintballs and being shaped for movement of said paintballs toward said reservoir discharge;

a transfer conduit having a proximal end connected to said reservoir discharge to receive said paintballs from said reservoir discharge, said transfer conduit having a distal end formed for connection to said paintball launcher and said transfer conduit being sized and shaped for supplying said paintballs in one by one sequence to said paintball launcher for ejection by said launcher; and a counter mechanism for counting each paintball moving through said transfer tube, said counter mechanism comprising a power supply for supplying electrical energy, an on-off switch positioned and configured to interconnect said power supply to and to disconnect said power supply from components of said counter mechanism, counting means positioned to operate between a first position in which no paintball is present in said transfer conduit proximate said counting means and a second position in which a paintball transiting from said proximal end to said distal end of said transfer conduit is in said transfer conduit proximate said counting means, and said counting means being configured to supply detection signals reflective of the presence of each transiting paintball proximate said counting means, interface means connected to said power supply to receive electrical energy therefrom, to said counting means to supply electrical energy to said counting means and to said counting means to receive said detection signals, said interface means being configured to generate counting signals reflective of the passage of each paintball through said transfer conduit, control means connected to receive electrical energy from said power supply, said control means being connected to said interface means to receive said counting signals, said control means being configured to process said counting signals and to supply image signals reflective of the count of paintballs passing through said transfer conduit, a timer for generating and supplying time signals reflecting time measured from a reference, timer controls positioned for operation by a user and connected to supply timer control signals to said timer, said timer control signals including activate, deactivate and reset signals for activating, deactivating and resetting said timer to said reference time, and an LCD display connected to receive said image signals from said control means and time signals from said time, said LCD display being configured to convert said image signals to visually perceivable images reflecting the count of paintballs passing through said transfer conduit and to convert said time signal to a visually perceivable image of time.

5. The hopper of claim 4 wherein said counting means is a flexible potentiometer having a proximal end secured to the wall of said transfer conduit and a distal end extending into said transfer conduit for contact and deflection by a paintball transiting from said proximal end to said distal end of said transfer conduit.

6. The hopper of claim 5 further including agitation means positioned in said hopper proximate said discharge, said agitation means being connected to said power supply and operable to agitate paintballs in said reservoir to facilitate movement of said paintballs into said transfer conduit through said discharge.

7. A hopper for dispensing paintballs to a paintball launcher, said hopper comprising:

a reservoir having a longitudinal axis, an interior, and exterior and a reservoir discharge through which paintballs exit said reservoir, said reservoir being sized to receive and retain a plurality of paintballs, said interior being shaped for directing movement of said paintballs by gravity toward said reservoir discharge, and said exterior being formed to have a top planar surface having a top surface axis, said top planar surface axis being oriented to intersect said longitudinal axis at an angle from about 15 degrees to about 30 degrees measured from said longitudinal axis to said top planar surface axis, and an under planar surface having an under planar surface axis, said under planar surface being oriented to intersect said longitudinal axis at an angle from about 30 degrees to about 45 degrees measured from said longitudinal axis to said under planar surface axis; and a transfer conduit having a proximal end connected to said reservoir discharge to receive said paintballs from said reservoir discharge, said transfer conduit having a distal end formed for connection to said paintball launcher and said transfer conduit being sized and shaped for supplying said paintballs in one by one sequence to said paintball launcher for ejection by said launcher.

8. A hopper for dispensing paintballs to a paintball launcher, said hopper comprising:

a reservoir having a longitudinal axis, a length, an interior, and exterior and a reservoir discharge through which paintballs exit said reservoir, said reservoir being sized to receive and retain a plurality of paintballs, said interior being shaped for directing movement of said paintballs by gravity toward said reservoir discharge with said longitudinal axis essentially horizontal, and said exterior being formed of a plurality of adjoining faceted planar surfaces angulating toward and forming a nose surface; and a transfer conduit having a proximal end connected to said reservoir discharge to receive said paintballs from said reservoir discharge, said transfer conduit having a distal end formed for connection to said paintball launcher and said transfer conduit being sized and shaped for supplying said paintballs in one by one sequence to said paintball launcher for ejection by said launcher.

9. The hopper of claim 8 wherein said hopper has opposite ends and a midpoint therebetween, wherein said plurality of faceted surfaces includes faceted rearward surfaces that taper from about said midpoint toward said opposite end.

10. A hopper for dispensing paintballs to a paintball launcher, said hopper comprising:

a reservoir having a longitudinal axis, an interior, and exterior and a reservoir discharge through which paintballs exit said reservoir, said reservoir being sized to receive and retain a plurality of paintballs, said interior being shaped for directing movement of said paintballs by gravity toward said reservoir discharge, and said exterior being formed of a plurality of faceted surfaces including a top planar surface having a top surface axis, said top planar surface being oriented to intersect said longitudinal axis at an angle from about 15 degrees to about 30 degrees measured from said longitudinal axis to said top surface axis, and an under planar surface having an under planar surface axis, said under planar surface being oriented to intersect said longitudinal axis at an angle from about 30 degrees to about 45 degrees measured from said longitudinal axis to said under planar surface axis; and a transfer conduit having a proximal end connected to said reservoir discharge to receive said paintballs from said reservoir discharge, said transfer conduit having a distal end formed for connection to said paintball launcher and said transfer conduit being sized and shaped for supplying said paintballs in one by one sequence to said paintball launcher for ejection by said launcher.

11. The hopper of claim 10 wherein said plurality of faceted surfaces includes a rear surface, and wherein a visual display is positioned on said rear surface.

12. A hopper for dispensing paintballs to a paintball launcher, said hopper comprising:

a reservoir having a longitudinal axis, an interior, and exterior and a reservoir discharge through which paintballs exit said reservoir, said reservoir being sized to receive and retain a plurality of paintballs, said interior being shaped for directing movement of said paintballs by gravity toward said reservoir discharge with said longitudinal axis essentially horizontal, and said exterior being formed to have at least one surface with a surface axis oriented to intersect said longitudinal axis at an angle from about 15 degrees to about 30 degrees measured from said longitudinal axis to said surface axis; and a transfer conduit having a proximal end connected to said reservoir discharge to receive said paintballs from said reservoir discharge, said transfer conduit having a distal end formed for connection to said paintball launcher and said transfer conduit being sized and shaped for supplying said paintballs in one by one sequence to said paintball launcher for ejection by said launcher.

13. The hopper of claim 12 wherein said reservoir is essentially conical in shape with a nose formed proximate the end with the smaller diameter in cross section.

14. The hopper of claim 12 wherein said exterior is formed of a plurality of faceted surfaces with said at least one faceted surface being a top surface, and where said exterior includes an under planar surface having an under planar surface axis, said under planar surface being oriented with said under surface axis to intersect said longitudinal axis at an angle from about 30 degrees to about 45 degrees measured from said longitudinal axis to said under planar surface axis.

* * * * *